United States Patent [19]

Cimenti et al.

[11] Patent Number: 5,046,908

[45] Date of Patent: Sep. 10, 1991

[54] INSTALLATION FOR CHARGING A SHAFT FURNACE

[75] Inventors: Giovanni Cimenti, Fentange; Emile Lonardi, Bascharage, both of Luxembourg

[73] Assignee: Paul Wurth S.A., Luxembourg, Luxembourg

[21] Appl. No.: 432,687

[22] Filed: Nov. 7, 1989

[30] Foreign Application Priority Data

Nov. 9, 1988 [LU] Luxembourg ..... 87379

[51] Int. Cl.[5] ..... F27B 11/00

[52] U.S. Cl. ..... 414/203; 414/170; 414/178; 414/205

[58] Field of Search ..... 414/149, 162, 163, 167, 414/168, 169, 170, 178, 199, 200, 201, 203, 204, 205

[56] References Cited

U.S. PATENT DOCUMENTS

| | | | |
|---|---|---|---|
| 2,375,371 | 5/1945 | Knehltan | 414/178 |
| 2,822,936 | 2/1958 | Hazle | 414/203 X |
| 3,623,709 | 11/1971 | Dorville | 414/203 |
| 3,759,404 | 9/1973 | Mahr | 414/203 |
| 4,512,702 | 4/1985 | Mailliet et al. | 414/201 X |
| 4,755,095 | 7/1988 | Mailliet et al. | 414/200 |
| 4,878,655 | 11/1989 | Henneken et al. | 414/203 X |

*Primary Examiner*—David A. Bucci

*Attorney, Agent, or Firm*—Fishman, Dionne & Cantor

[57] ABSTRACT

The installation comprises a chute for distributing the charging material, a skip transport system, a closed casing containing a device for the controlled sluicing of the charging material between the discharge by the skips and the distribution chute, a lower sealing valve and a proportioning valve opening symmetrically about a central axis, and a funnel-shaped hopper suspended rotatably within a sealed casing. A closing and material-deflecting plate is located in the hopper, this plate being movable vertically and axially within the hopper. A valve is associated with each of the skips in order to regulate the flow of material from the skips towards the hopper.

5 Claims, 3 Drawing Sheets

INSTALLATION FOR CHARGING A SHAFT FURNACE

TECHNICAL FIELD

The present invention relates to an apparatus for charging a shaft furnace.

BACKGROUND

Copending commonly assigned U.S. application Ser. No. 410,713, the disclosure of which is incorporated herein by reference, is directed to an apparatus for charging a shaft furnace. The apparatus provides a retrofittable system for rotatably suspending and driving a distribution chute. The chute replaces a conventional throat on an existing furnace with few modifications. The apparatus provides the advantages associated with use of a rotatable adjustable distribution chute to existing furnaces of small size. Charging material is typically provided to such an apparatus by a conventional skip conveyor.

One of the problems to be solved in this type of replacement is associated particularly with the lack of space available between the furnace head and the top of the skip conveyor. On the other hand, the installation must have a sufficiently high performance not to limit the transport capacity obtained by means of skips. Consequently, if there is a limit to the height in the design of the system for sluicing the charging material, this system must have an extensive width to be capable of absorbing the capacity of the skips. Now it is well known in this type of installation that the wider a hopper, the greater the problem of segregation, that is to say an irregular distribution of the material as a function of the granulometry, which occurs during the filling of the hopper and which is intensified when it is being emptied.

SUMMARY OF THE INVENTION

The object of the present invention is to provide a charging installation which makes it possible to reconcile the above problems satisfactorily, that is to say an installation which is only little bulk in terms of height and which makes it possible to keep the segregation in reasonable limits.

An apparatus for charging a shaft furnace is disclosed. The apparatus includes a casing mounted on the furnace head and a funnel-shaped hopper rotatably suspended within the casing. The hopper has an open top end for receiving charging material and an open bottom end for discharging the charging material. Transport means for delivering a stream of charging material through the top end of the casing to the hopper and flow control means for regulating flow of the stream of charging material from the transport means are also provided. A deflecting plate is mounted within the hopper. The plate has a closed position for closing the bottom end of the hopper and is movable vertically within the hopper from the closed position to define an annular orifice at the bottom end of the hopper. A proportioning valve is mounted in the bottom end of the casing for regulating flow of a stream of charging material from the annular orifice and a sealing valve is provided for closing the bottom end of the casing.

The hopper is preferably suspended on a vertical drive shaft seated and supported by means of a rolling bearing in the upper wall of the casing and subjected, outside the casing, to the action of a rotary drive pinion, while the said plate is fastened to the lower end of a rod sliding coaxially inside the said shaft under the action of a motor mounted above the said casing. The transport means includes a skip conveyor having a plurality of skips. Each skip includes a valve for regulating flow of material from the skip. Each valve can consist of a trap which is pivotable inside its skip under the action of the flow of material and the pivoting of which changes the cross-section of the flow orifice.

Other particular features and characteristics will emerge from the detailed description of a preferred embodiment given below as an illustration, with reference to the accompanying drawing in which:

DETAILED DESCRIPTION OF THE DRAWINGS

Figure 1:
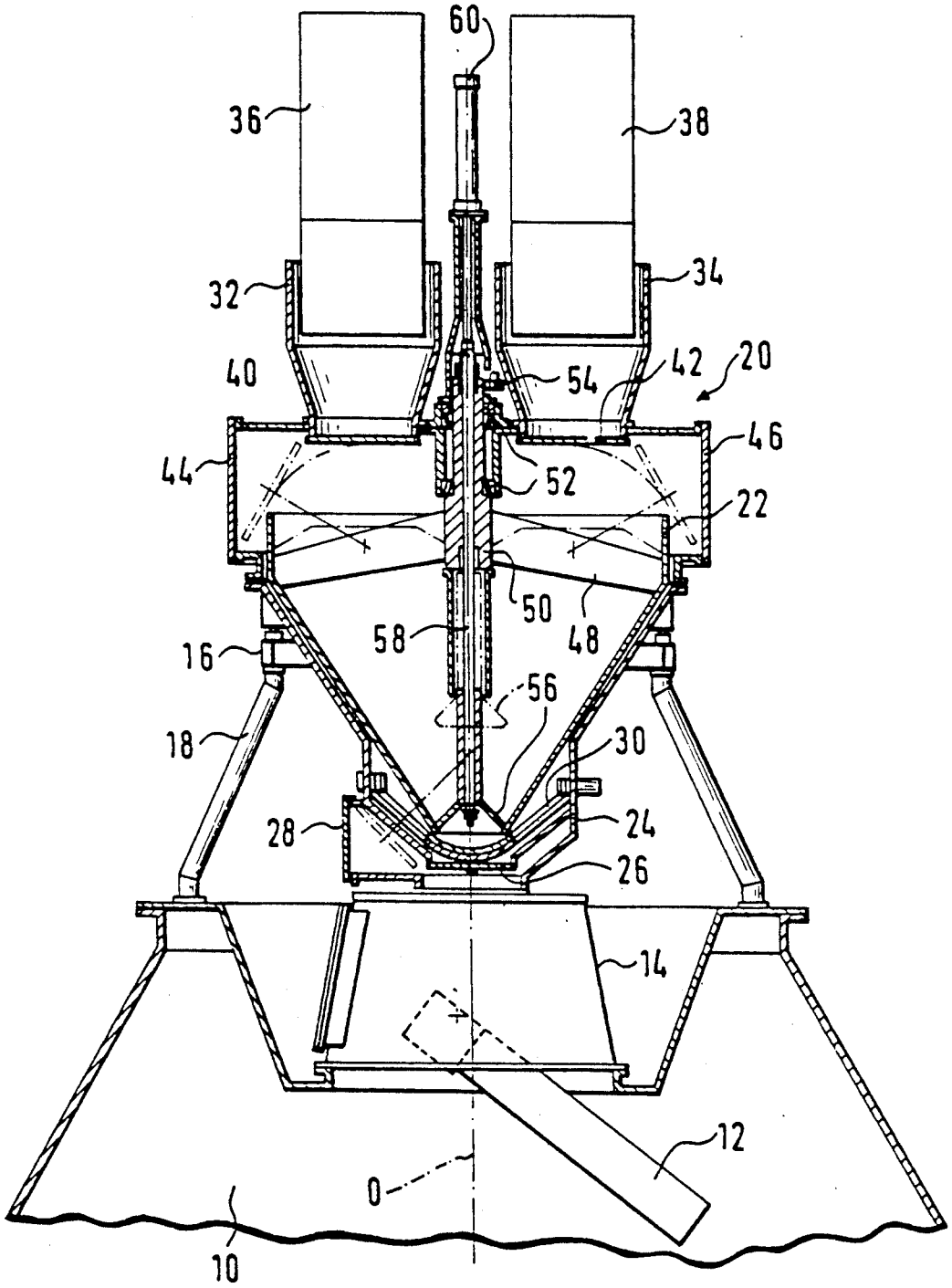
FIG. 1 shows an installation according to the present invention diagrammatically in vertical section.

FIG. 1 illustrates the upper part of a shaft furnace 10 with a chute 12 for distributing the charging material, suspended in a drive housing 14 which can be of the type described in the above-mentioned copending U.S. patent application No. 410,713.

The charging installation rests on a circular or square beam 16 which is supported by the head of the furnace 10 by means of several pillars 18. The installation has a closed metal casing 20, the central part of which is occupied by a funnel-shaped hopper 22 and the lower part of which is designed in the form of a valve cage 24 connectable to the housing 14 by means of compensator when the casing 20 is supported by load cells for determining its weight.

The valve cage 24 contains a sealing valve 26 represented in the closed position and open position respectively by unbroken lines and broken lines. This valve can be released and removed quickly via an easily accessible lateral orifice 28. The cage 24 also contains a proportioning valve 30 consisting, in a way known per se, of two pivoting gates suspended by means of diametrically opposed pivot axles in the lateral wall of the cage 24 and defining an adjustable orifice symmetrical about the vertical axis 0.

The casing 20 is surmounted by two connection pieces 32, 34 through which the charging material raised by two skip conveyors 36, 38 is discharged. Each of the passages through the connection pieces 32, 34 on the inside of the casing 20 is associated with a sealing valve 40, 42 of which the positions represented by unbroken lines and by broken lines denote respectively the closed positions and the open positions. The casing 20, like the valve cage 24, possesses two lateral covers 44, 46 allowing easy access to these valves 40, 42. These covers 44, 46 are provided on flanges which, at the same time, form the space for stowing these valves 40, 42 in the open position.

The hopper 22 is suspended inside the casing 20 by means of several, for example three or four radial cross-members 4B with a vertical axial shaft 50 capable of being driven in a rotational movement in order to rotate the hopper 22 about the vertical axis 0. For this purpose, the drive shaft 50 is seated and supported in the upper wall of the casing 20 by means of two rolling bearings 52, while the part of it emerging on the outside has a toothed ring which forms a gear with a drive pinion 54 actuated by means of a motor, for example an electric motor (not shown).

A plate 56 is mounted within the hopper 22 and is vertically movable within the hopper 22. The plate 56 is secured to the lower end of a rod 58 which is arranged coaxially within the drive shaft 50. Motor 60 is provided for moving the plate between a closed position, represented by the unbroken lines, wherein the plate closes off the outflow orafice of the hopper and an open position, represented by the broken lines, to provide an annular outflow orafice defined between plate 56 and the wall of the hopper 22.

Figure 2:
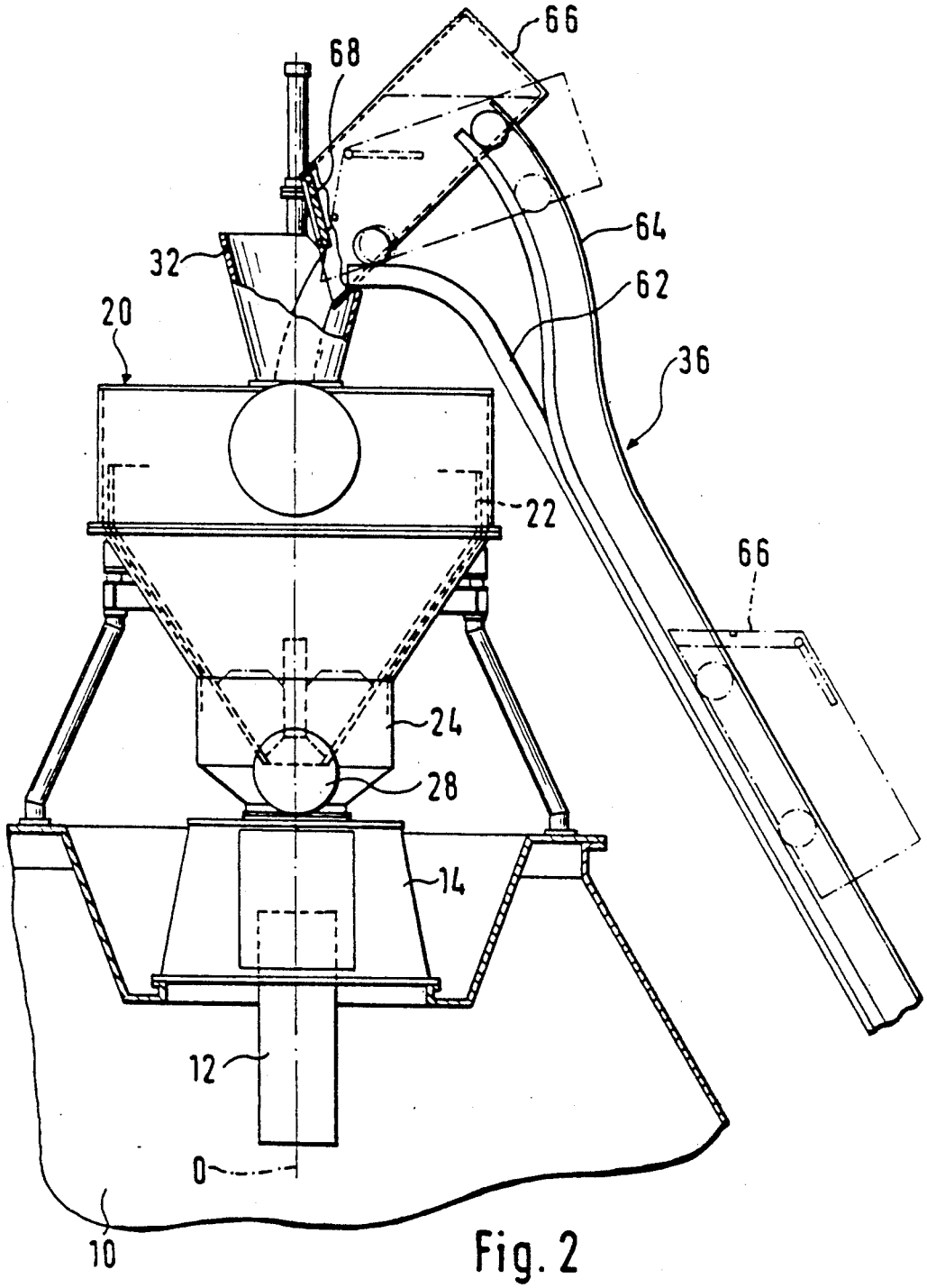
FIG. 2 shows a section taken in a plane opependicular to that of FIG. 1, with the details of the skip conveyor.

FIG. 2 shows the skip conveyor 36 in more detail. The conveyor 36 includes a rail 62 for the front running carriage of skip 66 and rail 64 for the rear running carriage of skip 66. Rails 62 and 64 diverge at their top ends to cause tilting of the skip as represented by broken lines and by unbroken lines in FIG. 2.

The conveyor 36 differs from a conventional skip conveyor in that the skip 66 is equipped with a valve 68 pivotably secured to the upper edge of the discharge opening of the skip 66 for varying the cross sectional area of the discharge opening of the skip 66.

Figure 3:
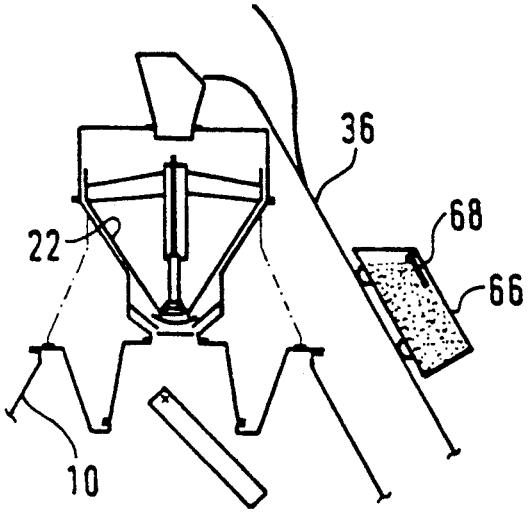
FIGS. 3–6 show diagrammatically different phases in the filling of the hopper by the skip conveyor.
Figure 4:
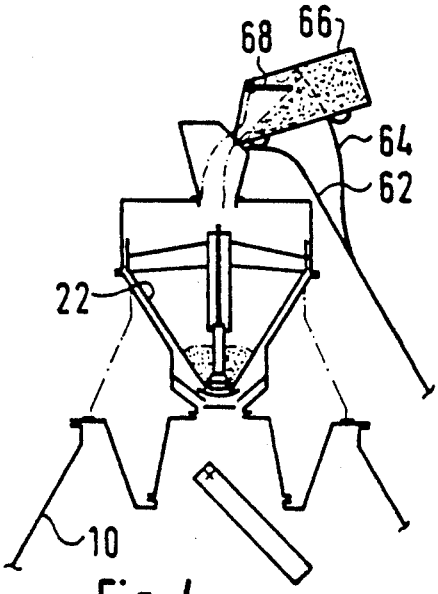
Figure 5:
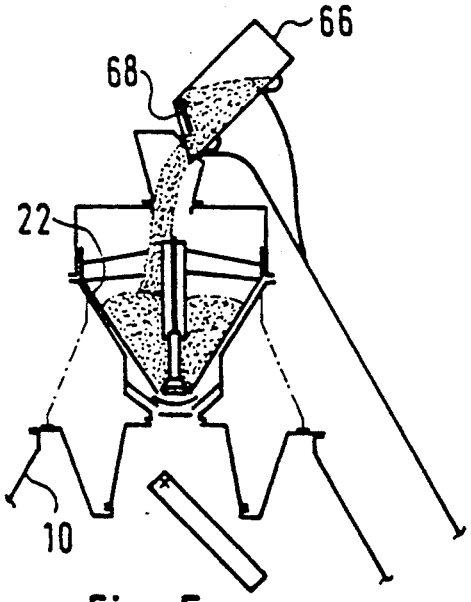
Figure 6:
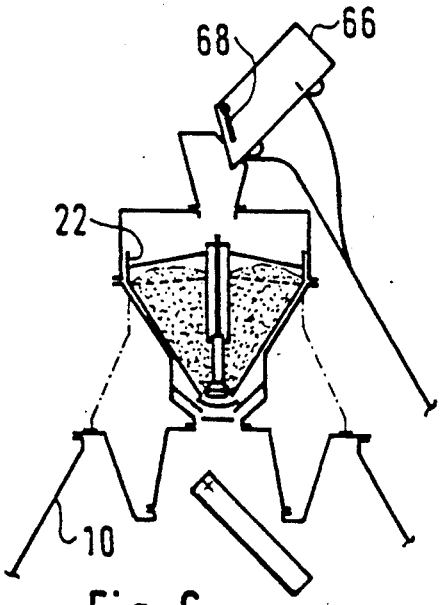

The operation of valve 68 is illustrated in FIGS. 3 to 6. In FIG. 3, the valve 68 occupies a first position turned down along the wall of skip 66. When the skip 66 is tilted as a result of the divergence of rails 62 and 64 the flow of material from the skip 66 drives the valve 68 through the position shown in FIG. 4 and into the position shown in FIG. 5 to reduce the cross sectional area of the flow orafice of skip 66. FIG. 6 shows an empty skip.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for charging a shaft furnace, said shaft furnace having a furnace head, a drive housing mounted on the furnace head and a distribution chute rotatably suspended from the drive housing, comprising:

a casing mounted on the furnace head, said casing having a cylindrical top portion downwardly extending from a top end and a conical bottom portion extending from the top portion to an open bottom end, said top end having openings for receiving charging material, a conical hopper rotatably suspended within the casing, said hopper having an open top end for receiving charging material and an open bottom end for discharging the charging material, means for rotatably suspending the hopper;

transport means for delivering a stream of charging material through the openings in the top end of the casing to the hopper, flow control means for regulating flow of the stream of charging material from the transport means to the hopper;

a deflecting plate within the hopper, said plate having a closed position for closing the bottom end of the hopper and said plate being movable vertically upwardly from the closed position to define an annular orifice at the bottom end of the hopper;

means for moving the deflecting plate vertically within the hopper;

means for regulating flow of a stream of charging material from the annular orifice.

2. The apparatus of claim 1, wherein the hopper rotates about a central axis and the means for rotatably suspending the hopper comprise a drive shaft, extending along the central axis of the hopper, bearing means for mounting the drive shaft in the casing and drive means for rotating the drive shaft.

3. The apparatus of claim 2, wherein the means for moving the deflecting plate comprises a rod, said rod being slidably received within the drive shaft and second drive means for positioning the rod relative to the drive shaft.

4. The apparatus of claim 1, wherein the means for regulating flow of a stream of charging material from the orifice comprises a proportioning valve mounted in the bottom end of the casing, and a sealing valve for closing the bottom end of the casing.

5. An apparatus for charging a shaft furnace, said shaft furnace having a furnace head, a drive housing mounted on the furnace head and a distribution chute rotatably suspended from the drive housing, comprising:

a casing mounted on the furnace head, said casing having a cylindrical top portion downwardly extending from a top end and a conical bottom portion extending from the top portion to an open bottom end, said top end having openings for receiving charging material, a conical hopper rotatably suspended within the casing, said hopper having an open top end for receiving charging material and an open bottom end for discharging the charging material, means for rotatably suspending the hopper;

transport means for delivering a stream of charging material through the openings in the top end of the casing to the hopper;

the transport means comprising a skip conveyor including a plurality of skips, each skip having a flow orifice of variable cross sectional area for discharging the charging material and the flow control means comprises a trap pivotably mounted within the skip wherein the trap is pivotably displaced by the flow of charging material from the skip to decrease the cross sectional area of the flow orifice of the skip.

* * * * *

UNITED STATES PATENT AND TRADEMARK OFFICE

CERTIFICATE OF CORRECTION

PATENT NO. : 5,046,908

DATED : Sept. 10, 1991

INVENTOR(S) : Giovanni Cimenti and Emile Lonardi

It is certified that error appears in the above-identified patent and that said Letters Patent is hereby corrected as shown below:

| | |
|---|---|
| Col. 2, **line 18** | Delete "opependicular" and insert therefore -- perpendicular --. |
| Col. 2, **line 66** | Delete "4B" and insert therefore -- 48 --. |
| Col. 3, **line 13** | Delete "orafice" and insert therefore -- orifice --. |
| Col. 3, **line 15** | Delete "orafice" and insert therefore -- orifice --. |
| Col. 3, **line 36** | Delete "orafice" and insert therefore -- orifice --. |
| Col. 4, **line 14** | Before "means" insert --valve --. |

Signed and Sealed this

Twenty-ninth Day of June, 1993

*Attest:*

*Attesting Officer*

Michael K. Kirk

MICHAEL K. KIRK

*Acting Commissioner of Patents and Trademarks*